US005101196A

United States Patent [19]

Koyama

[11] Patent Number: 5,101,196

[45] Date of Patent: Mar. 31, 1992

[54] DISPLAY DEVICE FOR MICROCOMPUTER

[75] Inventor: Hiroshi Koyama, Isesakishi, Japan

[73] Assignee: Sanyo Electric Co., Ltd., Osaka, Japan

[21] Appl. No.: 425,601

[22] Filed: Oct. 23, 1989

[30] Foreign Application Priority Data

Nov. 10, 1988 [JP] Japan ..... 63-284476
Nov. 11, 1988 [JP] Japan ..... 63-286043

[51] Int. Cl.[5] ..... G09G 1/16; G09G 1/06

[52] U.S. Cl. ..... 340/735; 340/750; 340/799

[58] Field of Search ..... 340/718, 731, 735, 748, 340/750, 749, 790, 800, 747, 799

[56] References Cited

U.S. PATENT DOCUMENTS

| | | | |
|---|---|---|---|
| 4,409,591 | 10/1983 | Simkovitz | 340/800 |
| 4,435,703 | 3/1984 | Hunt et al. | 340/749 |
| 4,504,826 | 3/1985 | Leininger | 340/750 |
| 4,570,161 | 2/1986 | Kummer et al. | 340/750 |
| 4,779,083 | 10/1988 | Ishii et al. | 340/784 |
| 4,947,342 | 8/1990 | Katsura et al. | 340/790 |

FOREIGN PATENT DOCUMENTS

| | | |
|---|---|---|
| 2951160A1 | 7/1980 | Fed. Rep. of Germany . |
| 3014437C2 | 5/1982 | Fed. Rep. of Germany . |
| 3130460A1 | 5/1982 | Fed. Rep. of Germany . |
| 3514821C2 | 10/1985 | Fed. Rep. of Germany . |
| 3434118A1 | 3/1986 | Fed. Rep. of Germany . |
| 3609208A1 | 9/1987 | Fed. Rep. of Germany . |
| 1420548 | 1/1976 | United Kingdom . |
| 1547340 | 6/1979 | United Kingdom . |

OTHER PUBLICATIONS

LCD Window Controller Makes Instrument Displays Easy. In: Electronic Design—Jul. 28, 1988, H. 17 S.137-140; Ed Klingman.

LCD-Punkt-Matrix-Module und ihre Ansteuerung. In: Design & Elektronik, p. 25, vol. 25, 11/24/86.

IBM Technical Disclosure Bulletin, vol. 30, No. 7, Dec. 1987, S.311-313.

*Primary Examiner*—Alvin E. Oberley
*Assistant Examiner*—Darin Miller
*Attorney, Agent, or Firm*—Oliff & Berridge

[57] ABSTRACT

A display device for a microcomputer including a RAM for display, a ROM for a character generator, a changeover gate, a parallel/serial conversion circuit, a display circuit, and a display controlling circuit. A plurality of registers and a plurality of counters are incorporated in the display controlling circuit.

2 Claims, 5 Drawing Sheets

| FIG. 3A | FIG. 3B |
|---|---|

DISPLAY DEVICE FOR MICROCOMPUTER

BACKGROUND OF THE INVENTION

The present invention relates to a display device for a microcomputer.

Conventionally, in order to drive a liquid crystal display (LCD) of m×n dots (m, n: natural numbers), the following components are required: a RAM for display; a ROM for a character generator; a changeover gate for changing, an output from the display RAM or the character generator ROM; a liquid crystal driving circuit for driving segment electrodes and common electrodes of the LCD; and a liquid crystal display controlling circuit for controlling the operating timings of the aforementioned RAM, ROM changeover gate, and liquid crystal driving circuit.

First, in the case of executing graphic display, if an arbitrary address of the display RAM is designated by the liquid crystal display controlling circuit in a state in which display data corresponding to the dots of the LCD is stored in the RAM, the display data read out from the designated address of the RAM is delivered to the liquid crystal driving circuit via the changeover gate, thereby effecting display on the LCD with respect to each dot.

In addition, in the case of executing character display, a predetermined character pattern is set in advance in the character generator ROM by means of a mask. Then, if an arbitrary address of the display RAM is designated by the liquid crystal display controlling circuit in a state in which a character code corresponding to the predetermined character pattern is stored in the RAM, the character code read out from the designated address of the RAM is converted to display data by the character generator ROM. Subsequently, the display data is delivered to the liquid crystal driving circuit via the changeover gate, thereby effecting character display on the LCD (see Japanese Patent Laid-Open No. 175893/1988).

In the above-described conventional art, a timing controlling circuit for controlling the operating timings of the display RAM, the character generator ROM, the changeover gate, and the liquid crystal driving circuit is incorporated in the liquid crystal display controlling circuit. Therefore, if a predetermined character pattern is set in the a character generator ROM by means of a mask so as to effect character display, the mask for the timing controlling circuit is conventionally changed in such a manner that a timing controlling signal corresponding to the set contents of the ROM is generated by the timing controlling circuit, i.e., in correspondence with the set contents of the ROM.

However, although the contents of character patterns stored in the character generator ROM are open to the user, the timing controlling circuit must be made to correspond to the ROM by changing the mask each time a new character font is set in the ROM. Accordingly, there have been drawbacks because the masks are expensive, a long time is required to produce a mask following a request of the user, and required for each mask. Consequently, the user is compelled to defray huge expenses due to increased development costs, while the developer is unable to speedily provide a device desired by the user.

SUMMARY OF THE INVENTION

Accordingly, an object of the present invention is to provide a display device for a microcomputer which is capable of overcoming the above-described drawbacks of the prior art.

To this end, in accordance with the present invention, there is provided a display device for a microcomputer comprising: a RAM for display in which data is stored; a ROM for a character generator for generating display data on the basis of data read out from a designated address of the display RAM; a changeover gate for changing an output of the display RAM or the character generator ROM so as to output display data; a parallel/serial conversion circuit for performing a parallel to serial conversion of the display data obtained from the changeover gate a display circuit to which the display data output from the parallel/serial conversion circuit is input serially; and a display controlling circuit for controlling the display RAM, the character generator ROM, the changeover gate, the parallel/serial conversion circuit, and the display circuit, wherein the display controlling circuit includes a plurality of registers in which, on the basis of a predetermined character pattern of a character font set in the character generator ROM, data characterizing the character pattern is set, and a plurality of counters for controlling the display RAM, the character generator ROM, and the parallel/serial conversion circuit on the basis of data set in the plurality of registers.

The display device in accordance with the present invention is effectively used for a microcomputer, as described below. In other words, various items of data set in the plurality of registers are preset in the plurality of counters, and then the plurality of counters effect counting, and the display, RAM the character generator ROM, and the parallel/serial conversion circuit are controlled by counted outputs of the plurality of counters. As a result, a character pattern pertaining to character display is set without any need to change a mask.

In addition, an arrangement may be provided such that the display circuit is formed as a circuit for a dot matrix display device and includes a shift register to which the display data output from the parallel/serial conversion circuit is input serially, a display data latch circuit for latching the display data output in parallel from the shift register through control by the display controlling circuit, a segment driving circuit for driving segment electrodes of a display unit of the dot matrix display device on the basis of the display data output from the display data latch circuit, and a common drive circuit for driving a common electrode of the display unit.

In this case, the display data is input to the shift register from the parallel/serial conversion circuit, and parallel display data subjected to parallel/serial conversion by the shift register is latched by the display dat latch circuit. In addition, the segment electrodes in the display unit are driven on the basis of the display data output from the display data latch circuit.

In the present invention, an arrangement may be provided such that, with respect to the contents to be displayed on the display unit, at least one of a) the horizontal character pitch and vertical character pitch of a character to be displayed, b) the number of characters in a horizontal direction, and c) the display duty in a vertical direction is controlled by a predetermined register among the plurality of registers and a predetermined counter corresponding to the predetermined register among the plurality of counters.

In addition, the display RAM may be arranged such that access to the RAM for writing/reading the display data is effected by a CPU, and access thereto for reading the display data is effected nonsynchronously by the display controlling circuit.

In the present invention, the device may be integrated on a single semiconductor chip.

In accordance with the present invention, if a predetermined character font is set on the character generator ROM by means of a mask, the timing of generation of characters displayed on a display unit can be controlled by a program on the basis of contents set in the character generator ROM. In addition, in the graphic mode as well, the timing of generation of characters to be displayed on the display unit can be controlled by a program in a similar manner. Accordingly, it becomes unnecessary to change the mask for the display controlling circuit, as has heretofore been the conventional practice. Hence, it is possible to obtain the advantages that the user is able to hold down expenditures because of a reduction in the development cost, and that the developer is able to speedily provide a device desired by the user.

The above and other objects, features and advantages of the present invention will become more apparent from the following detailed description of the invention when read in conjunction with the accompanying drawings.

DESCRIPTION OF THE PREFERRED EMBODIMENT

Referring now to the accompanying drawings, a detailed description will be given of the preferred embodiment of the present invention.

Figure 1:
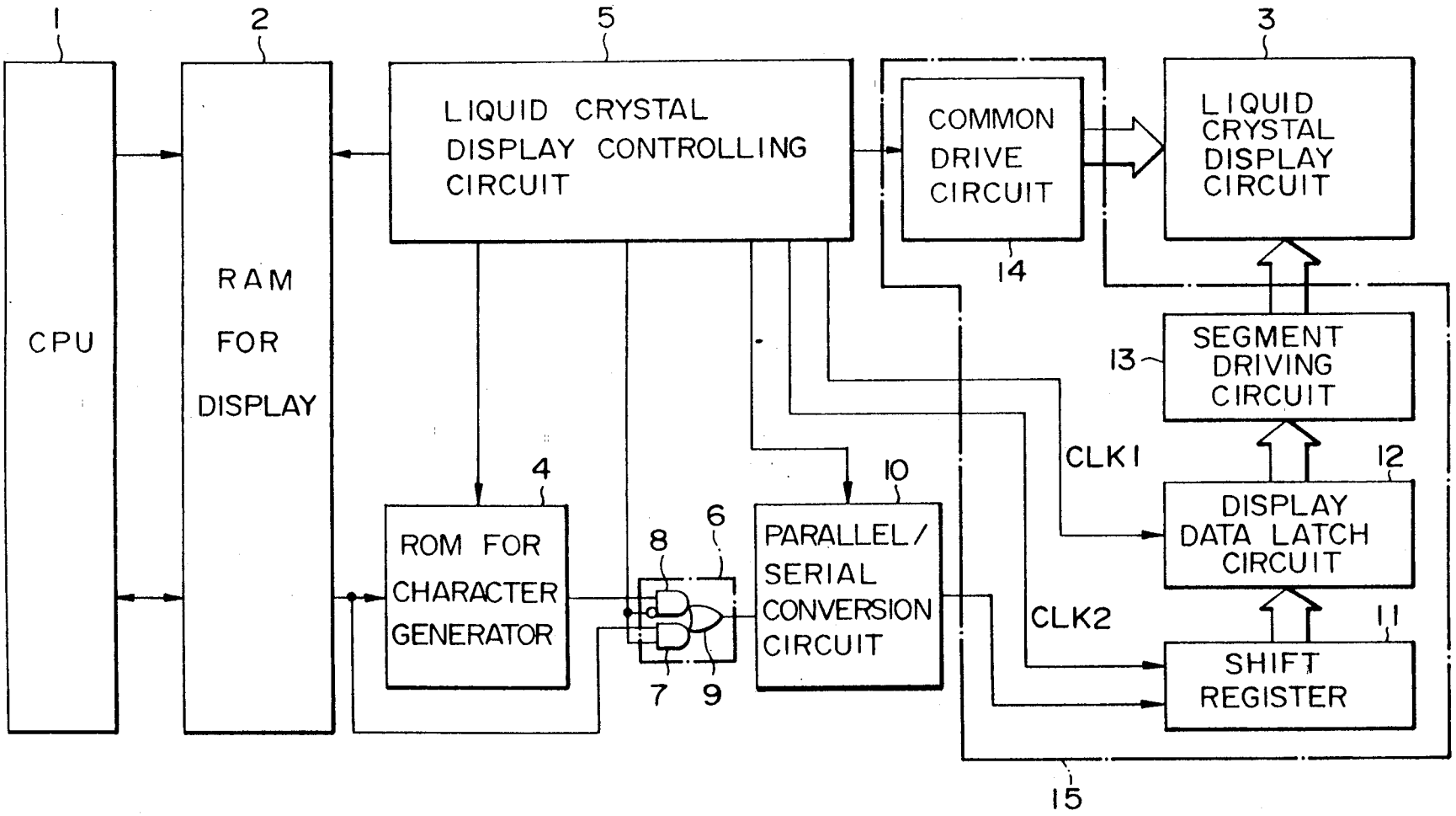
FIG. 1 is a block diagram illustrating a configuration of a display device for a microcomputer in accordance with an embodiment of the present invention, in which a liquid crystal display controlling circuit including characteristic features of the invention is denoted by reference numeral 5.

Referring to FIG. 1, a description will be given of the configuration of a display device in accordance with the present invention. When data is written in a RAM 2 for display with a dual port and 40×8 bits, it suffices if a predetermined address of RAM 2 is designated by a CPU 1, and the data is written at the designated address of RAM 2 by the CPU 1. In addition, when data is read from RAM 2, it suffices if a predetermined address of RAM 2 is designated by the CPU 1 in the same way as the aforementioned case, and the data is read out from the designated address of RAM 2. In this case, the operation of the CPU 1 is controlled on the basis of the read data.

A liquid crystal display circuit (LCD) 3 is exteriorly attached to a semiconductor chip and comprises a dot matrix of 40 horizontal dots×8 vertical dots.

The contents of character patterns stored in a ROM 4 for a character generator are open to the user through mask options. It is assumed that 160 kinds of arbitrary character patterns of character font with a maximum of five horizontal dots and seven vertical dots can be set in ROM 4 by the use of masks.

In cases where 8-bit character codes are stored in RAM 2, when a predetermined address of RAM 2 is designated by a liquid crystal display control circuit 5, an 8-bit character code corresponding to designated address is read out from the RAM 2. Furthermore, when a predetermined address of ROM 4 corresponding to that character code is designated, or, more specifically, if columns of a character pattern set in a predetermined address of ROM 4 are sequentially designated for a maximum of seven dots, the aforementioned character code is developed into a dot pattern by ROM 4.

A display data changeover gate 6 indicated by a dot-dash line comprises AND gates 7, 8 and an OR gate 9. The state of changeover gate 6 is changed by a changeover signal output by liquid crystal display controlling circuit 5.

In other words, in the case of a graphic mode in which data is stored in RAM 2 such that 1-bit data stored in RAM 2 corresponds to the turning on and off of one dot of liquid crystal display circuit 3, AND gate 7 is operated by a changeover signal of "1" from liquid crystal display controlling circuit 5, and AND gate 8 is closed.

Meanwhile, in the case of a character mode in which 8-bit character codes are stored in RAM 2, as described above, AND gate 8 is operated by a changeover signal of "0" from liquid crystal display controlling circuit 5, and AND gate 7 is closed.

Since data read out from the RAM 2 is composed of parallel 8 bits, eight AND gates 7 are required for use in the graphic mode. On the other hand, a maximum number of data items read out at a time from ROM 4 is composed of parallel five bits corresponding to the row of five dots of the character pattern, so that five AND gates 8 are required for use in the character mode. In order to meet these two requirements, eight changeover gates 6 are provided. (However, only one changeover gate 6 is illustrated in the drawing.)

A total of eight input terminals of the eight AND gates 7 used in the graphic mode are connected in parallel with read-out side of the RAM 2, while a total of five input terminals of the five AND gates 8 used in the character mode are connected in parallel with the read-out side of ROM 4.

The input side of a parallel/serial conversion circuit 10 is connected in parallel with a total of eight output terminals of the eight OR gates 9 disposed in the eight changeover gates 6.

For this reason, an output of 8-bit data from RAM 2 or an output of 5-bit data from ROM 4 is supplied to the parallel/serial conversion circuit 10 via changeover gates 6. These outputs of data are respectively fetched by parallel/serial conversion circuit 10 on the basis of a timing control signal from liquid crystal display control circuit 5.

Data output from parallel/serial conversion circuit 10 is set in a 40-bit shift register 11. The data set in shift register 11 is 40-bit serial data for turning on and off a horizontal row of 40 dots of liquid crystal display circuit 3 and is used to display one horizontal row of liquid crystal display circuit 3. The setting of this data in shift register 11 is effected on the basis of clock signal CLK2 from liquid crystal display controlling circuit 5.

When clock signal CLK1 is delivered from liquid crystal display controlling circuit 5 to a 40-bit display data latch cicruit 12, 40-bit data set in the shift register 11 is latched by display data latch circuit 12.

A segment driving circuit 13 is adapted to drive any of 40 vertical segment electrodes of the liquid crystal display circuit 3 on basis of the latch data of the display data latch circuit 12.

A common drive circuit 14 is adapted to drive any of eight horizontal common electrodes of the liquid crystal display circuit 3 on basis of a control output from the liquid crystal display controlling circuit 5. In addition, shift register 11, the display data latch circuit 12, segment drive circuit 13, and the common drive circuit 14 constitute a display circuit 15.

By virtue of above-described configuration display is provided by the liquid crystal display circuit 3.

Figure 2:
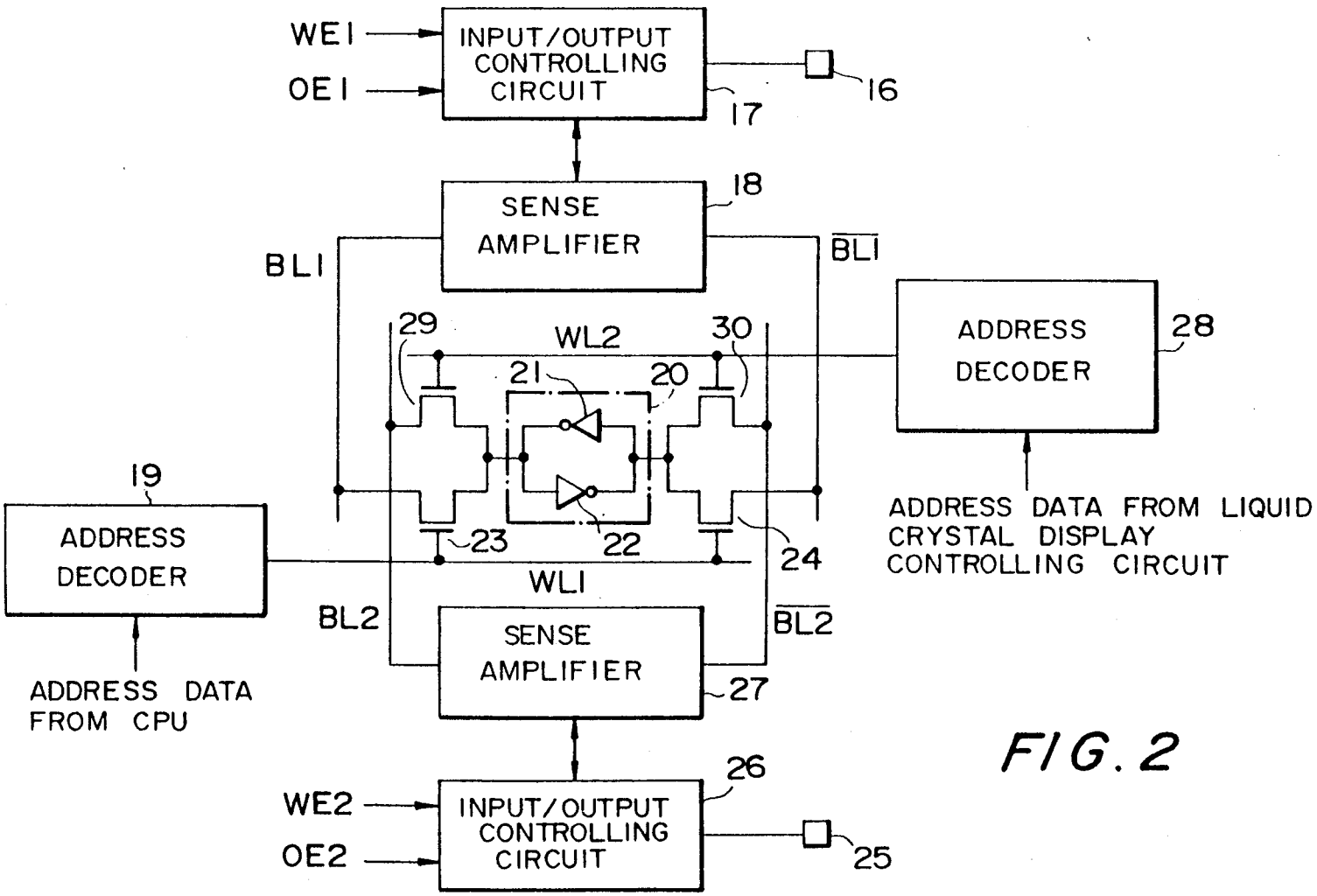
FIG. 2 is a circuit diagram illustrating the configuration of a RAM 2 for display in the embodiment shown in FIG. 1.

FIG. 2 shows a configuration of RAM 2.

In RAM 2 shown in FIG. 2, a write controlling signal WE1 and an output controlling signal OE1 are sent to an output controlling circuit 17. In order to set an input-/output port 16 in an input state, it suffices if WE1="1", and OE1="0". On the other hand, in order to set the input/output port 16 in an output state, it suffices if WE1="0", and OE1="1".

Bit lines BL1, $\overline{BL1}$ of a mutually complementary type are connected to a sense amplifier 18.

A word line WL1 is connected to an address decoder 19 which decodes address data delivered from CPU 1.

A memory cell 20 indicated by a dot-dash line comprises a pair of inverters 21, 22 each having input and output terminals inversely connected to their counterparts.

The gate of a MOS transistor 23 is connected to word line WL1. One end of drain-source channel of the MOS transistor 23 is connected to bit line BL1, while the other end of the drain-source channel is connected to one of the input/output terminals of memory cell 20.

The gate of another MOS transistor 24 is connected to the word line WL1. One end of the drain-source channel of MOS transistor 24 is connected to the bit line $\overline{BL1}$, while the other end of the drain-source channel is connected to other input-output terminal of the memory cell 20.

In the above-described configuration, at the time when a one-bit portion of data is stored in memory cell 20, the following operation is carried out. First, a write address of RAM 2 is accessed by the CPU 1, i.e., address data from CPU 1 is decoded by address decoder 19, and word line WL1 is selected. At this time, when input/output port 16 is set in the input state, data of one of the eight bits delivered to the input/output port 16 from CPU 1 is input to sense amplifier 18 via input/output controlling circuit 17. After this one-bit portion of data is amplified by sense amplifier 18, data is superposed on the bit line BL1 from sense amplifier 18, and is delivered to one input/output terminal of memory cell 20 via MOS transistor 23. Similarly, inverted one-bit data superposed on bit line $\overline{BL1}$ from the sense amplifier 18 is delivered to other input/output terminal of the memory cell 20 via the MOS transistor 24. As a result, the one-bit portion of data is stored in memory cell 20.

On other hand, at the time when a one-bit portion of data is read out from the memory cell 20, the following operation is carried out. First, a read address of RAM 2 is accessed by CPU 1, and the word line WL1 is selected. At this time, when input/output port 16 is set in output state, a one-bit portion of data stored in memory cell 20 is amplified by the sense amplifier 18 via the MOS transistors 23, 24, and is then output from the input/output port 16 via input/output controlling circuit 17.

Similarly, write controlling signal WE2 and output controlling signal OE2 are sent to an input/output controlling circuit 26. An input/output port 25 is used exclusively for reading, so that a setting is provided in such a fixed manner that WE2="0", and OE2="1".

A sense amplifier 27 is connected to bit lines BL2, $\overline{BL2}$.

An address decoder 28 is connected to a word line WL2 and is adapted to decode address data sent from liquid crystal display controlling circuit 5.

The gate of a MOS transistor 29 is connected to word line WL2. One end of drain-source channel of the MOS transistor 29 is connected to bit line $\overline{BL2}$, while the other end of the drain-source channel thereof is connected to one input/output terminal of memory cell 20.

The gate of a MOS transistor 30 is connected to word line WL2. One end of drain source channel of the MOS transistor 30 is connected to bit line BL2, while the other end of the drain-source channel thereof is connected to other input/output terminal of the memory cell 20.

In the above-described configuration, at the time when a one-bit portion of data is read out from memory cell 20, the following operation is carried out. First, a read address of RAM 2 is accessed by liquid crystal display controlling circuit 5, and word line WL2 is selected. At this time, a one-bit portion of data stored in memory cell 20 is amplified by sense amplifier 27 via MOS transistors 29, 30, and is then output from input-/output port 25 via input/output controlling circuit 26. Subsequently, this one-bit portion of data is stored in display circuit 15 via changeover gate 6 and parallel/-serial conversion circuit 10 in the latter stage.

It is assumed that address decoders 19, 28 are capable of decoding data in eight bits, that WE1 and OE1 are commonly delivered to input/output controlling circuit 17 in eight bits, and that WE2 and OE2 are similarly commonly delivered to input/output controlling circuit 26 in eight bits.

If the dual-port RAM 2 having the above-described configuration is used, since CPU 1 and liquid crystal display controlling circuit 5 are capable of nonsynchronously accessing a predetermined address of RAM 2, display of characters by the liquid crystal display circuit 3 can be effected speedily, and the flickering of displayed characters can be overcome. For instance, in liquid crystal display circuit 3, in scroll display or the like in which displayed characters flow from right to left and the display changes consecutively, it is necessary to constantly rewrite contents of the RAM 2. In the case of a single-port display RAM, since the contents of the display RAM must be rewritten by a program in which control timing of the liquid display controlling circuit 5 is taken into consideration, program steps are complicated. If the dual-port RAM 2 is used, it is possible to rewrite display data of the RAM 2 by disregarding control timing of the liquid crystal display circuit 5, so that the program steps can be simplified.

In addition, since RAM 2 and segment driving circuit 13 are not directly connected to each other, it becomes unnecessary to dispose RAM 2 in vicinity of the segment driving circuit 13 on one chip, which permits a free pattern layout of RAM 2.

Figures 3, 3A:
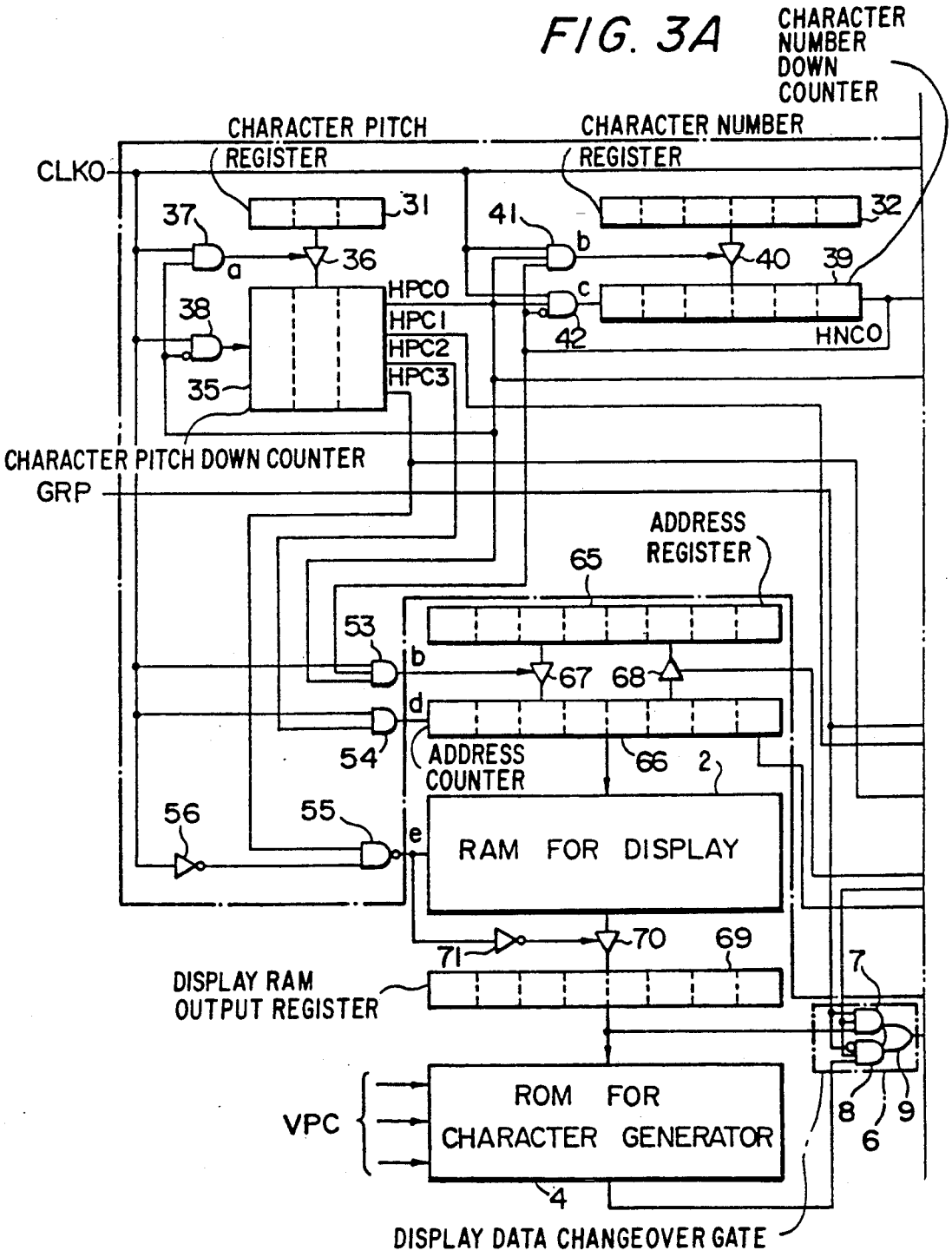
FIG. 3*a* and 3*b* is a circuit diagram of the liquid crystal display controlling circuit 5 in the embodiment shown in FIG. 1 and the peripheral circuitry thereof, illustrating registers 31, 32, 33, 34 and counters 35, 39, 43, 49 that are a characteristic feature of the invention.
Figure 3B:
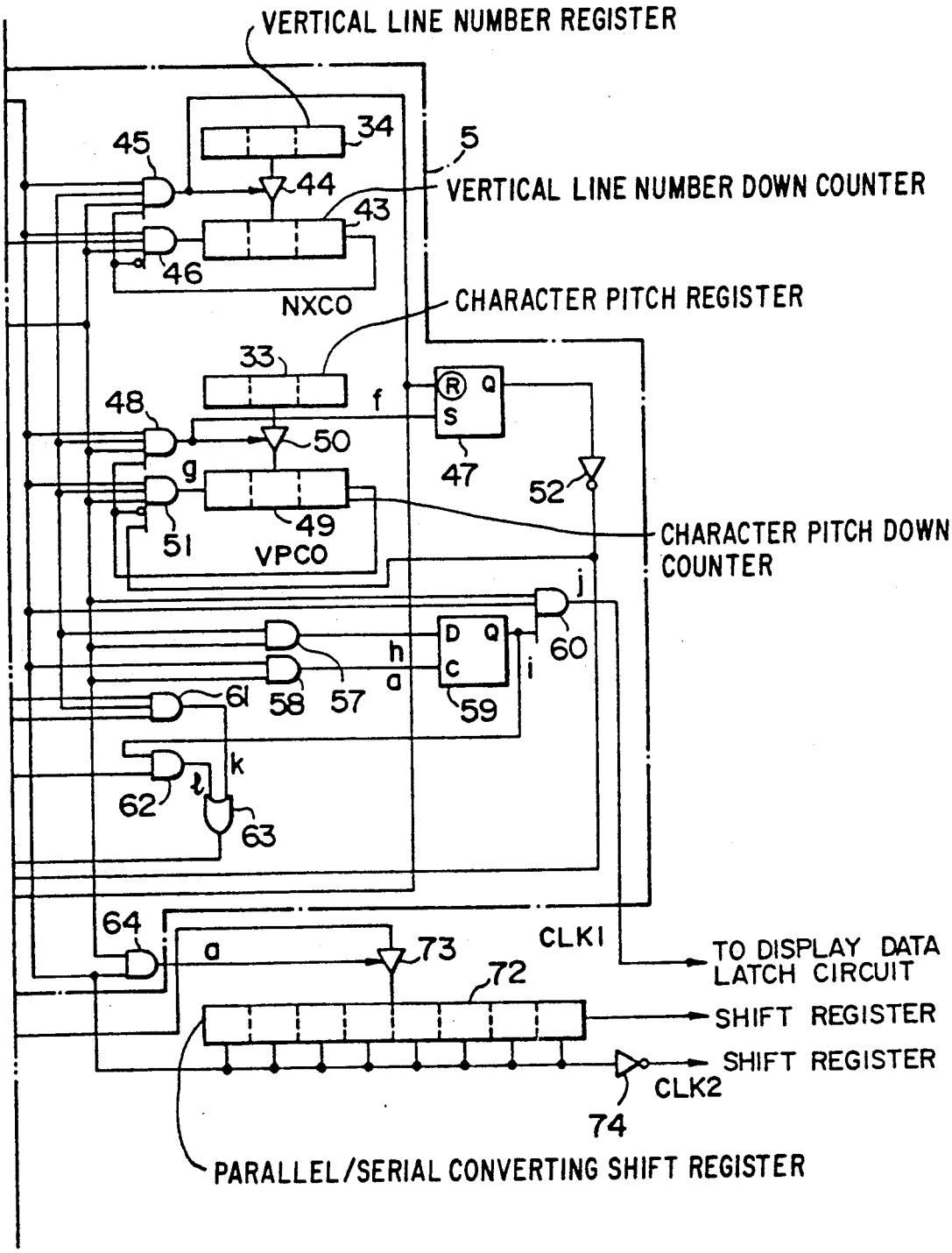

FIG. 3 illustrates configuration of the liquid crystal display controlling circuit 5 and its peripheral circuitry, including a characteristic configuration of the present invention.

First, a description will be given of the internal configuration of liquid crystal display controlling circuit 5.

In a 3-bit character pitch register 31, which constitutes a feature of the present invention, the horizontal character pitch (the number of horizontal dots for one character) of characters displayed on liquid crystal display circuit 3 is set on a binary basis. The reason why register 31 is three bits is to allow the horizontal character pitch in the character mode to be set in the range of 4–8 and the horizontal character pitch in the graphic mode to 8 ($=2^3$).

In a 6-bit character number register 32, which constitutes another feature of the present invention, the number of horizontal characters displayed on liquid crystal display circuit 3 is set on a binary basis. The reason why register 32 is six bits is to allow the number of characters per horizontal line in the character mode to be set in the range of 1–40. The number of horizontal characters in the graphic mode is set to 5, i.e., a number obtained by dividing horizontal 40 dots in the liquid crystal display circuit 3 by the number of horizontal dots, 8.

In a 3-bit character pitch register 33, which constitutes still another feature of the present invention, the vertical character pitch (the number of vertical dots for one character) of characters displayed on liquid crystal display circuit 3 is set on a binary basis. The reason why register 33 is three bits is to allow the vertical character pitch in the character mode to be set in the range of 1–7 and the vertical character pitch in the graphic mode in the range of 1–8.

In a 3-bit vertical line number register 34, which constitutes a further feature of the present invention, the number of vertical lines (display duty) of characters to be displayed on liquid crystal display circuit 3 is set. The reason why register 34 is three bits is to allow the number of vertical lines in the character and graphic modes to be set in the range of 1–8.

In a 3-bit down counter 35, which constitutes a still further feature of the present invention, the horizontal character pitch set in register 31 is preset via a buffer 36 for three bits. Down counter 35 counts down horizontal character pitch. When the down counter 35 counts down from counts "011" to "000", i.e., when the last four dots in the horizontal character pitch are counted down, down counter 35 sequentially issues signals HPC3, HPC2, HPC1, and HPC0 that are "1".

An AND gate 37 receives signal HPC0 and clock CLK0 which is synchronous with HPC3, HPC2, HPC1 and HPC0.

In other words, when down counter 34 counts the final dot of the preset horizontal character pitch and the count becomes "000", HPC0 is set to "1". Upon generation of CLK0 when HPC0 is "1", an output a of AND gate 37 becomes "1". Buffer 36 is driven by this output a, and the horizontal character pitch is preset in down counter 35 whose count has been "000".

An AND gate 38 receives clock CLK0 and signal $\overline{\text{HPC0}}$. In other words, if clock CLK0 is generated when $\overline{\text{HPC0}}$ is "1" before the final dot of the horizontal character pitch is counted, down counter 35 starts a count down by the output "1" of AND gate 38.

In a 6-bit character number down counter 39, which is a further feature of the present invention, the number of horizontal characters set in register 32 is preset via a buffer 40 for six bits. When count of the down counter 39 becomes "000000", down counter 39 issues signal HNC0 of "1".

An AND gate 41 receives CLK0, HPC0 and HNC0.

In other words, when count of the down counter 39 becomes "000000" in response to the fall of HPCO from "1", HNC0 represents the position of a final one of the horizontal characters. At this time, the final dot of the horizontal character pitch is counted, and HPC0 having the "1" level is generated. In addition, when clock CLK0 is generated, buffer 40 is driven by a "1"-level output b of AND gate 41, and the number of horizontal characters set in register 32 is preset in down counter 39 whose count has been "000000".

An AND gate 42 receives CLK0, HPC0 and $\overline{\text{HNC0}}$.

In other words, when HNC0 is "1" before the count of down counter 39 becomes "000000", the final dot of the horizontal character pitch in each horizontal character is counted by down counter 35, and HPC0 of the "1" level is generated. In addition, if clock CLK0 is generated when such HPC0 of the "1" level is being generated, an output c of AND gate 42 falls down from "1", and down counter 39 effects a count down in response to the fall down.

In a 3-bit vertical line number down counter 43, which relates to a further feature of the present invention, the number of vertical lines set in register 34 is preset via a buffer 44 for three bits. When count of the down counter 43 becomes "0000", the down counter issues NXC0 of the "1" level.

An AND gate 45 receives CLK0, HPC0, HNC0 and $\overline{\text{NXC0}}$.

In other words, in response to the fall down of HPC0 from "1", count of the down counter 43 is set to "000", and NXC0, consequently shifts to "1" indicating the final line in the number of vertical lines. In addition, HNC0 of the "1" level is generated while NXC0 of the "1" level is being generated, and when HNC0 of the "1" level is being generated, the final dot of the horizontal character pitch is counted by down counter 35, HPC0 becomes "1". In addition, if clock CLK0 is generated when HPC0 is "1", an output "1" is output from AND gate 45, and buffer 44 is driven by this output. Subsequently, the number of vertical lines set in register 34 is preset in the down counter 43 whose count has been "000".

An AND gate 46 receives CLK0, HPC0, HNC0 and NXC0.

In other words, NXC0 of the "1" level is generated before count of the down counter 43 becomes "000", and HNC0 of the "1" level is generated for each vertical line. In addition, during each period when HNC0 of the "1" level is generated, HPC0 of the "1" level is generated, and if clock CLK is generated during each period when HPC0 of "1" level is being generated, the down counter 43 effects a count down in response to shift-down of the AND gate 46 from "1".

An RS flip-flop 47 with priority on reset is reset by output "1" of the AND gate 45, and is set by an output f of the "1" level of an AND gate 48 which will be described later.

In a 3-bit character pitch down counter 49, the vertical character pitch set in register 33 is preset via a buffer 50 for three bits. When count of the down counter 49 becomes "000", down counter 49 issues VPC0 of the "1" level.

The AND gate 48 receives CLK0, HPC0, HNC0 and VPC0.

When count of the down counter 49 becomes "000" in response to the fall-down of HPC0 from "1", the level of VPC0 becomes "1". In addition, HNC0 of the "1" level is generated at the time when VPC0 is "1", and during the time when HNC0 of the "1" level is being generated, HPC0 of the "1" level is generated. Furthermore, when clock CLK0 is generated during the period when HPC0 of the "1" level is being generated, buffer 50 is driven by a "1"-level output f of AND gate 48, and the vertical character pitch set in register 33 is preset in down counter 49, whose count has been "000".

An AND gate 51 receives CLK0, HPC0, HNC0 and $\overline{VPC0}$ as well as an output Q of RS flip-flop 47 via an inverter 52.

In other words, when output Q of the RS flip-flop 47 is "0", during the time when $\overline{VPC0}$ of the "1" level is generated before count of the down counter 49 becomes "000", HNC0 of the "1" level is generated for each vertical dot. In addition, during each period when HNC0 of the "1" level is being generated, the final dot of the horizontal character pitch is counted, and HPC0 of the "1" level is generated. Furthermore, if clock CLK0 is generated during each period when HPC0 of the "1" level is being generated, an output g of AND gate 51 falls down from "1", and down counter 49 effects a count down in response to that fall-down.

An AND gate 53 receives CLK0, HPC0, and HNC0 and outputs an AND output b of these signals.

An AND gate 54 receives CLK0 and HPC2 and outputs an AND output d OF these signals.

A NAND gate 55 receives $\overline{CLK0}$ via an inverter 56 and HPC3 and outputs an NAND output e of these signals.

An AND gate 57 receives HPC0 and HNC0 and outputs an AND output h of these signals.

An AND gate 58 receives CLK0 and HPC0 and outputs an AND output a of these signals.

A D flip-flop 59 has a D (data) terminal to which the output h of AND gate 57 is input and a C (clock) terminal to which an output a of AND gate 58 is input.

An AND gate 60 receives CLK0, HPC0, and an output i of a Q (output) terminal of flip-flop 59 and outputs an AND output j of these signals. A "1"-level output j of AND gate 60 is used as a latch clock for display data latch circuit 12.

An AND gate 61 receives mode changeover signal GRP, HPC1 and HNC0 and outputs an AND output k. The mode changeover signal GRP is set to "1" during the graphic mode, and "0" during the character mode.

An AND gate 62 receives HPC3 and Q output of the D flip-flop 59 and outputs an AND output of these signals.

An OR gate 63 receives outputs of the AND gates 61, 62.

An AND gate 64 receives CLK0 and HPC0 and outputs an AND output a.

Liquid crystal display controlling circuit 5 has the above-described configuration.

An 8-bit address counter 66 accesses an address of RAM 2 shown in FIG. 1.

Eight buffers 67 are interposed between the output terminal of an 8-bit address register 65 and the input terminal of address counter 66 in correspondence with the respective eight bits.

The contents set in the register 65 are preset in the address counter 66 via buffers 67 driven by a "1"-level output b of the AND gate 53.

Eight buffers 68 are interposed between the input terminal of the register 65 and output terminal of address counter 66 in correspondence with respective bits.

The contents of address counter 66 are preset in the register 65 via buffers 68 driven by output "1" of OR gate 63, and is reset by the output "1" of the AND gate 45, and is further incremented by "1"-level output d of the AND gate 54.

Eight buffers 70 are connected to the read side of the RAM 2 and the input side of an 8-bit display RAM output register 69 in correspondence with the respective bits.

The address of RAM 2 counted by address counter 66 is accessed at the timing of "0"-level output e of NAND gate 55. Then, when buffers 70 are driven by a "1"-level output e supplied from NAND gate 55 via an inverter 71, 8-bit data written in a designated address of RAM 2 is set in register 69 via buffers 70.

When 8-bit character code set in the register 69 is input to ROM 4 shown in FIG. 1, an arbitrary character pattern of ROM 4 is designated by means of that character code.

Then, when the vertical dots of a character to be displayed on liquid crystal display circuit 3 are sequentially designated by 3-bit VPC, dot patterns of a maximum of five bits are output sequentially from ROM 4.

With reference to the eight changeover gates 6 indicated by the dot-dash line, input to the input terminals of eight AND gates 7 respectively included in the changeover gates 6 are the outputs of the 8-bit data set in register 69, mode changeover signal GRP, and inverter 52. In addition, input to the five input terminals of the eight AND gates 8 are the five-bit outputs output from ROM 4, mode changeover signal $\overline{GRP}$, and output of the inverter 52.

Eight 8-bit buffers 73 are connected between the output side of OR gate 9 and input side of the shift register 56 in correspondence with the respective eight bits.

When buffers 73 are driven by a "1"-level output a of AND gate 64, outputs of changeover gates 6 are input in parallel to an 8-bit shift register 72. Subsequently, the contents of shift register 72 are output serially by clock CLK0 applied to bits of the shift register 72, and is set 11 in shift register in FIG. 1 up to 40 bits. In addition, CLK2 ($=\overline{CLK0}$), i.e., a signal obtained by inverting CLK0 by an inverter 74, is also delivered to shift register 11 as its shift clock.

The foregoing is a description of the configuration shown in FIG. 3.

Figure 4:
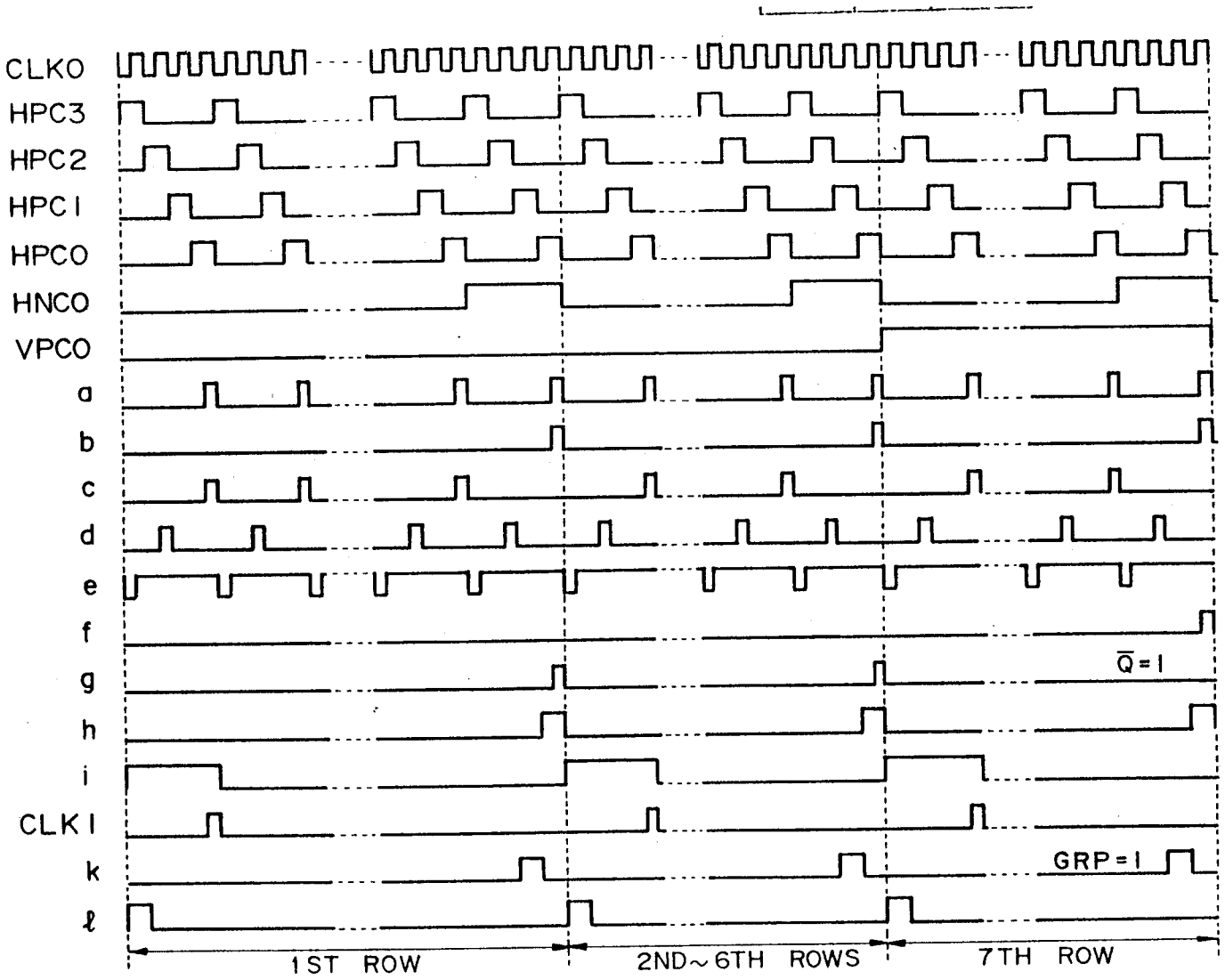
FIG. 4 is a timing chart explaining the operation of the liquid crystal display controlling circuit 5 shown in FIG. 3 and illustrating parts of waveforms of the signals of the liquid crystal display controlling circuit 5.

Referring now to a timing chart shown in FIG. 4, a description will be given of the operation of FIG. 3.

First, in a case where characters are displayed on liquid crystal display circuit 3 in the character mode, for instance, the horizontal character pitch is 4, the number of horizontal characters is 10, and the vertical character pitch is 7, and the number of vertical lines (rows) is set to 8 by assuming that the cursor display or the like is performed at the vertical line in the lowest significant position. Furthermore, "011" indicating the horizontal character pitch is set in register 31, "001001" indicating number of horizontal characters is set in the register 32, "110" indicating the vertical character pitch is set in register 33, and "111" indicating the number of vertical lines is set in register 34.

In initial state, it is assumed that the down counters 35, 39, 49, 43 are respectively preset at "011", "001001", "110", and "111", and that content of the address counter 66 is "00000000". In addition, it is assumed that the eight AND gates 8 are set in the operating state by mode changeover signal GRP of the "0" level, and that output of the ROM 4 is selected by changeover gate 6.

First, down counter 35 starts a count down in response to a drop in "1" output of the AND gate 38, and when it issues HPC3 of the "1" level, the "0000" address of RAM 2 is accessed by the "0"-level output e of NAND gate 55.

At this time, since buffers 70 are driven by e of "1" level via the inverter 71, the 8-bit character code written in "0000" address of the RAM 2 is set in register 50 via buffers 70.

Then, a character pattern corresponding to that character code is designated by ROM 4. By this designation, a four-bit dot pattern for first row and the first character is issued by the ROM 4 in such a manner that one-bit data corresponds to the turning on/off of one dot.

Furthermore, buffers 68 are driven by the "1"-level output l of AND gate 62, and count "00000000" of the address counter 66 is set in register 65.

Then, when HPC2 of "1" level is generated by the down counter 35, count of the address counter 66 is incremented from "00000000" to "00000001". That is, the "0001" address of RAM 2 is counted by address counter 66.

When HPC0 of "1" level is issued from the down counter 35 following HPC1 of "1" level, the AND gate 38 is closed to inhibit operation of the down counter 35, and buffer 36 is driven by "1"-level output a of the AND gate 37. Therefore, content set in the register 31 is preset again in down counter 35.

In response to a drop in output c of the AND gate 42 from "1" level, the down counter 49 counts down by one, so that the number of horizontal characters is decremented by one.

In addition, since buffers 73 are driven by the "1"-level output a of AND gate 64, the 4-bit output from ROM 4 is input to the right four bits of shift register 72 via changeover gate 6 and buffers 73.

The 4-bit data input in parallel to shift register 72 is output serially in response to rise of a four-clock portion of CLK0 which is generated immediately after that time, and the 4-bit data is input serially to the shift register having a 40-bit configuration in response to a fall of CLK2 which is delayed by a ½ cycle behind CLO0.

Then, when the output l of the AND gate 62 shifts down from "1" to "0", and if above-described operation is repeated in a state in which the transfer of the contents of the address counter 66 is inhibited, the 4-bit data for the first row and second to ninth characters are consecutively input serially to the shift register 11.

Subsequently, when down counter 35 effects a count down in response to the drop of the "1"-level output of AND gate 38 and issues HPC3 of the "1" level, the "1001" address of RAM 2 is accessed by the "0"-level output e of NAND gate 55. At this time, the character code written in "1001" address of the RAM 2 set in register 69 via the buffers driven by the output $\bar{e}$ of the "1" level.

A character pattern corresponding to that character code is then designated by ROM 4, which issues a 4-bit dot pattern for the first row and the tenth character. Subsequently, when HPC0 of the "1" level is generated by down counter 35 following HPC2 and HPC1 both of "1" level, the buffers 73 are driven by output a of the "1" level output from the AND gate 64. Consequently, 4-bit output of the ROM 4 is input in parallel to right four bits of the shift register 72 via buffers 73 and is input serially to shift register 11 in a similar manner.

As a result, 40-bit serial data is set in shift register 11.

In addition, on basis of HPC0 of the "1" level, the AND gate 38 is closed, operation of the down counter 35 is inhibited, and buffer 36 is driven by the "1"-level output $\bar{a}$ of AND gate 37. Hence, contents of the register 31 are preset again in down counter 35.

HNC0 of the "1" level representing the position of a final one of the horizontal characters in the first row is generated by down counter 39, so that AND gate 42 is closed and the operation of down counter 39 is inhibited, while buffer 40 is driven by the "1"-level output b of the AND gate 41. Consequently, the contents of register 32 are preset again in down counter 39 via buffer 40.

Down counters 43, 49 respectively effect a count down in response to "1"-level output of the AND gate 46 and "1"-level output of the AND gate 51 based on HPC0 and HNC0 both of the "1" level, so that the number of vertical lines and the vertical character pitch are decremented by one.

Furthermore, since buffers 67 are driven by the "1"-level output b of AND gate 53, "00000000" initially set in register 65 is preset in address counter 66.

Namely, address of the RAM 2 is returned to "0000" address of the RAM 2 for each vertical line. The reason for this is that the character pattern of ROM 4 corresponding to one character code has a matrix of four horizontal dots×seven vertical dots, and unless the address of RAM 2 is returned to the original address each time the line is fed, only a portion of four horizontal dots×one vertical dot in one character pattern can be displayed on liquid crystal display circuit 3.

Simultaneously as 40-bit serial data is set in the shift register 11, CLK1 of a "1"-level output is generated by AND gate 60, and contents of the shift register 11 are latched in parallel by display data latch circuit 12 by that CLK1. As a result, the first horizontal row of liquid crystal display circuit 3 having a matrix of 40 horizontal dots×eight vertical dots is displayed on the basis of two outputs of the segment driving circuit 13 driven by display data latch circuit 12 and common drive circuit 14 driven by liquid crystal display controlling circuit 5.

As the above-described operation is repeated seven times, characters are displayed on liquid crystal display circuit 3. However, the eight row used for cursor display or like has not been counted down by the down counter 43. That is, count down operation of the down counter 49 and the operation of changeover gate 6 must be inhibited until NXC0 of "1" level is generated by the down counter 43. (A description of cursor display is omitted herein.)

For that reason, when VPC0 of the "1" level is generated at seventh row, the AND gate 51 is closed to inhibit operation of down counter 49, and the buffer 50 is driven by "1"-level output f of the AND gate 48. Hence, the arrangement is simply such that the contents of register 33 are preset in down counter 49 via buffer 50.

In addition, since the RS flip-flop 47 is set by the output f of "1" level, a "0" level data obtained by inverting the "1"-level Q terminal output of RS flip-flop 47 by inverter 52 is delivered to both AND gates 7, 8, thereby closing changeover gate 6. In consequence, the 4-bit output from ROM 4 on the basis of character code set in the register 69 and the 3-bit VPC is suppressed, so that the display of the eighth row in liquid crystal display circuit 3 is inhibited.

Subsequently, when cursor display or the like at the eighth row in liquid crystal display circuit 3 is completed and NXCO of "1" level is generated from the down counter 43, AND gate 46 is closed to inhibit the counting operation of down counter 43, and buffer 44 is driven by "1"-level output of the AND gate 45. Therefore, contents of register 34 are preset in the down counter 43 via buffer 44.

Furthermore, when RS flip-flop 47 is reset by the "1"-level output of AND gate 45, "1"-level data obtained by inverting "0"-level Q terminal output of the RS flip-flop 47 by inverter 52 is delivered to AND gate 51 to operate AND gate 51, so that down counter 49 starts counting operation.

In addition, "1"-level output of inverter 52 is sent to the AND gates 7, 8, so that the AND gates 7, 8 also operate.

This completes a series of operation for effecting character display on liquid crystal display circuit 3 in the character mode.

A desrciption will now be given of a case where characters are displayed on liquid crystal display circuit 3 in the graphic mode. For instance, under the assumption that, for instance, the horizontal character pitch is set to eight (fixed), the number of horizontal characters to five (fixed), and the vertical character pitch to eight, and the number of vertical lines to eight, "111" representing horizontal character pitch is set in the register 31, "000100" representing the number of horizontal characters is set in register 32, "111" representing the vertical character pitch is set in register 33, and "111" representing the number of vertical lines is set in register 34.

In the initial state, it is assumed that "111", "000100", "111", and "111" are respectively preset in down counters 35, 39, 49, 43, and that content of the address counter 66 is "00000000".

In addition, the eight AND gates 7 are set in the operating state by mode changeover signal GRP of the "1" level, and a setting is provided such that changeover gate 6 selects the 8-bit output of register 69 as it is.

The difference in operation between this graphic mode and the above-described character mode lies in that it is unnecessary to return address of the RAM 2 to its original address per vertical line. In other words, since information to be displayed for each eight horizontal dots on liquid crystal display circuit 3 is stored in different addresses of RAM 2 as 8-bit data, it merely suffices to increment address of the RAM 2 when line feed is carried out. Specifically, in the operation for a one-row portion, address counter 66 is incremented by "1"-level output d of the AND gate 54, and buffers 68 are subsequently driven by the "1"-level output k of AND gate 61 on the basis of HNC0 and HPC1. Accordingly, contents of the address counter 66 are set in register 65, and the aforementioned count as incremented is then returned from register 65 to address counter 66 by means of "1"-level output b of the AND gate 53 based on HNC0 and HPC0.

As a result, even if line feed carried out, the count of address counter 66 continues to be incremented.

When the character display of an eight-row portion in graphic mode is completed, the contents of the address counter 66 are reset by "1"-level output of the AND gate 45.

The remainder of the operation is basically identical to that of the above-described character mode, and character display in graphic mode is thus effected on the liquid crystal display circuit 3.

By virtue of the above-described configuration, if a predetermined character font is set on ROM 4 by means of a mask, the horizontal character pitch, the number of horizontal characters, the vertical character pitch, the number of horizontal characters, the vertical character pitch, the number of vertical lines, etc. of characters displayed on liquid crystal display circuit 3 can be set by a program on the basis of contents set in the ROM 4. In other words, the timing of generation of characters can be controlled by the program, and, in the graphic mode as well, the aforementioned four values of character displayed on liquid crystal display circuit 3 can be set by the program. Accordingly, it becomes unnecessary to change over a mask for liquid crystal display controlling circuit 5, which has been the conventional practice. Hence, the user is able to hold down expenditures because of a reduction in development cost, while the developer is able to speedily provide a device desired by the user.

It should be noted that, to order in readily change the drive bias of liquid crystal display circuit 3, it suffices if a circuit for generating a liquid crystal driving voltage (not shown) is provided which incorporates a plurality of resistors connected in series between a power source $V_{pp}$ and ground and is provided with output terminals at points of connection between each resistor. If an arbitrary output terminal is short-circuited by wiring bonding, respective drive bias voltages are generated from the circuit for generating a liquid crystal driving voltage. In addition, if these voltages are applied to segment driving cirucit 13 and common drive circuit 14, display is effected on liquid crystal display circuit 3 with a predetermined drive bias.

As described above, in accordance with the present invention, if a predetermined character font is set on ROM 4 by means of a mask, the timing of generation of characters displayed on a display unit can be controlled by a program on the basis of contents set in ROM 4. In addition, in the graphic mode as well, the timing of generation of characters to be displayed on the display unit can be controlled by a program in a similar manner. Accordingly, it becomes unnecessary to change the mask for the display controlling circuit, which has conventionally been practiced. Hence, it is possible to obtain, the advantages that the user is able to hold down expenditures because of a reduction in the development cost, and that the developer is able to speedily provide a device desired by the user.

What is claimed is:

1. A display device for a microcomputer comprising:

(a) a CPU for controlling the operation of the microcomputer;

(b) a display RAM in which dot display data or character codes are stored;

(c) an address counter for designating the addresses of selected contents of said display RAM;

(d) an address register for retaining the contents transferred from address counter;

(e) a character generator ROM for generating predetermined dot display data in response to a character code read from a specified address of said display RAM;

(f) changeover means responsive to a display mode control signal for either outputting in a graphic display mode dot display data read from said display RAM or outputting in a character display mode dot display data read from said character generator ROM;

(g) means for parallel/serial conversion of the dot display data outputted by said changeover means;

(h) a display unit circuit for controlling a display having electrode segments and common electrodes, said display circuit comprising:

a shift register to which the converted dot display data output by said parallel/serial conversion means is serially input;

a display data latch circuit for latching the dot display data output from said shift register serially;

a segment drive circuit for driving said display segment electrodes in response to dot display data output by said display data latch circuit; and a common drive circuit for driving said display common electrodes; and (i) a display control circuit for controlling said display RAM, said address counter, said address register, said character generator ROM, said changeover means, said parallel/serial conversion means and said display circuit; said display control circuit comprising:

character pitch register means in which data representing a horizontal character pitch and a vertical character pitch of a character to be displayed by said display is stored;

character pitch counter means for counting the contents of said character pitch register means;

a character number register in which data representing the number of characters to be displayed in a line of characters in a horizontal direction of said display is stored;

a character number counter for counting the contents of said character number register;

a display duty register in which data representing the number of character lines to be displayed relative to a vertical direction of the display is stored;

a display duty counter for counting the contents of said display duty register; and logic means for controlling said address register and address counter responsive to the display mode selected and the outputs of said character pitch counter means, said character number counter and said display duty counter such that the contents of said address register are transferred to said address counter each time the display of a horizotal line of characters to be displayed by said display has been completed, and the transfer of the contents of said address counter to said address register is controlled according to the display mode selected.

2. A display device for a microcomputer comprising:

(a) a CPU for controlling the operation of the microcomputer;

(b) a dual port display RAM in which dot display data or character codes are stored, said CPU accessing said display RAM with an access timing for reading/writing of the dot display data and character codes in said display RAM;

(c) an address counter for designating the address of selected contents of said display RAM;

(d) an address register for retaining the contents transferred from address counter;

(e) a character generator ROM for generating predetermined dot display data in response to a character code read from a specified address of said display RAM;

(f) changeover means responsive to a display mode control signal for either outputting in a graphic display mode dot display data read from said display RAM or outputting in a character display mode dot display data read from said character generator ROM;

(g) means for parallel/serial conversion of the dot display data outputted by said changeover means;

(h) a display circuit for controlling a display having electrode segments and common electrodes, said display circuit comprising:

a shift register to which the converted dot display data output by said parallel/serial conversion means is serially input;

a display data latch circuit for latching the dot display data output from said shift register serially;

a segment drive circuit for driving said display segment electrodes in response to dot display data output by said display data latch circuit; and a common drive circuit for driving said display common electrodes; and (i) a display control circuit for controlling said display RAM, said address counter, said address register, said character generator ROM, said changeover means, said parallel/serial conversion means and said display circuit; said display control circuit comprising:

means for accessing the dot display data and character codes stored in said display RAM asynchronously with said CPU access timing;

character pitch register means in which data representing a horizontal character pitch and a vertical character pitch of a character to be displayed by said display in stored;

character pitch counter means for counting the contents of said character pitch register means;

a character number register in which data representing the number of characters to be displayed in a line of characters in a horizontal direction of said display is stored;

a character number counter for counting the contents of said character number register;

a display data register in which data representing the number of character lines to be displayed relative to a vertical direction of the display is stored;

a display duty counter for counting the contents of said display duty register;

means for generating said mode control signal to control said changeover means;

logic means for controlling said address register and address counter responsive to the outputs of said character pitch counter means, said character number counter and said display duty counter such that:

in said character display mode, address data for displaying the leading character of a horizontal character line is set in said address counter when displaying a leading character of each line to be displayed, the leading character address data is transferred to said address register and then transferred to said address counter each time the display of a horizontal line of characters to be displayed by said display has been completed; and in said graphics mode, address data for displaying the leading data of an initial horizontal line of data is set in said address counter, the contents of said address counter are incremented and retained in said adddress register after an address for displaying a last data of each horizontal line has been accessed, and the incremented contents of the address register are then transferred to said address counter after said last data has been displayed.

* * * * *